United States Patent [19]

Parrish

[11] Patent Number: 4,966,295

[45] Date of Patent: Oct. 30, 1990

[54] DIETING PLATE ARRANGEMENT WITH MOVABLE PARTITIONS

[76] Inventor: Carolyn L. Parrish, 608 Arrington, Diboll, Tex. 75941

[21] Appl. No.: 392,409

[22] Filed: Aug. 11, 1989

[51] Int. Cl.[5] ..... B65D 25/06

[52] U.S. Cl. ..... 220/22.3; 220/427; 220/428; 220/23.83; 206/459

[58] Field of Search ..... 220/22.3, 22.2, 22.1, 220/22, 426, 427, 428, 23.8, 23.83; 206/459

[56] References Cited

U.S. PATENT DOCUMENTS

| | | | |
|---|---|---|---|
| 2,322,665 | 6/1943 | Ryan | 220/428 |
| 2,457,875 | 1/1949 | Day | 220/22.3 |
| 2,577,959 | 12/1951 | Gattuso | 220/22.1 |
| 2,598,789 | 6/1952 | Harrell | 220/22 |
| 2,700,284 | 1/1955 | Lyon | 220/23.8 |
| 2,719,413 | 10/1955 | Panzer | 220/22 |
| 3,155,260 | 11/1964 | Widener | 220/426 |
| 3,279,514 | 10/1966 | Mintz | 220/22 |
| 3,518,164 | 6/1970 | Andelin | 206/459 |
| 3,608,770 | 9/1971 | Naimoli | 220/428 |
| 3,680,729 | 8/1972 | Bonavent | 220/22 |
| 3,720,346 | 3/1973 | Cypher | 220/22.3 |
| 3,734,337 | 5/1973 | Garrison | 220/22 |
| 3,760,985 | 9/1973 | Bryan | 220/22.1 |
| 3,766,975 | 10/1973 | Todd | 220/428 |
| 3,812,997 | 5/1974 | McNally | 220/22 |
| 4,385,554 | 5/1983 | Daenen | 220/22.3 |
| 4,708,256 | 11/1987 | Intardonato | 220/23.83 |
| 4,830,190 | 5/1989 | Inagaki | 220/22.3 |

FOREIGN PATENT DOCUMENTS

| | | | |
|---|---|---|---|
| 2119633 | 11/1983 | United Kingdom | 220/22 |

*Primary Examiner*—Stephen Marcus
*Assistant Examiner*—S. Castellano
*Attorney, Agent, or Firm*—Leon Gilden

[57] ABSTRACT

A dieting plate arrangement is set forth utilizing a compartmentalized dish provided with compartments of predetermined fluid capacity consistent with dieting portions of weight conscious individuals. The plate includes a further scale on one or more of the compartments for indication of quantity based upon varying density of fluid positioned within the compartments. A removable divider includes partition walls securable within the plate, wherein the partition walls may include walls formed of a hollow chamber, a fluid chamber, or a combination thereof to accommodate various dishes of various temperature radiance. A further embodiment includes a central hub formed with cylindrical recesses to accommodate cylindrical terminal ends of divider walls to enable selective division when the divider walls and central hub are positioned within the plate.

4 Claims, 4 Drawing Sheets

Fig 7
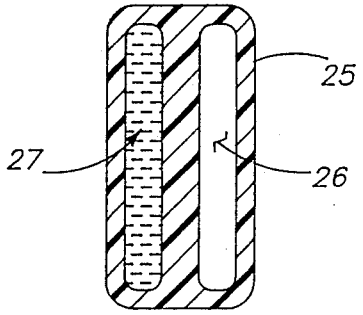
Fig 8
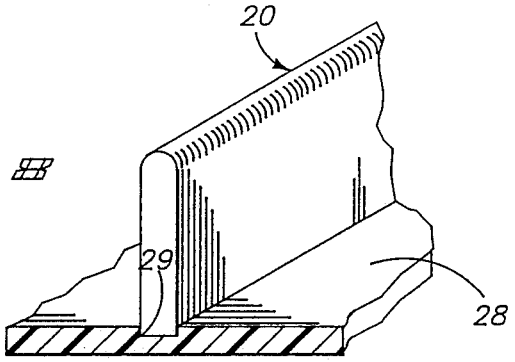
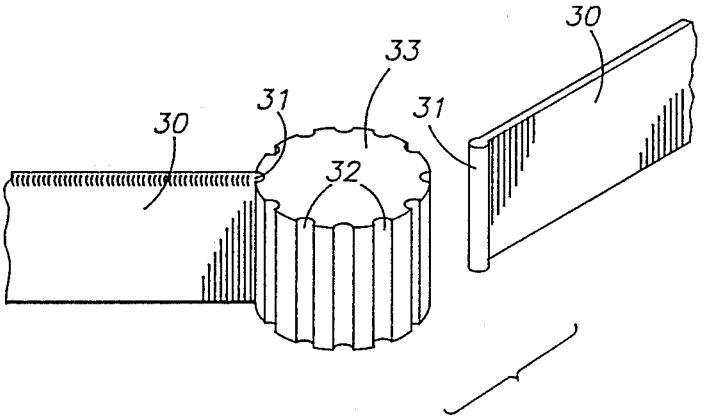
Fig 9

DIETING PLATE ARRANGEMENT WITH MOVABLE PARTITIONS

BACKGROUND OF THE INVENTION

1. Field of the Invention

The field of invention relates to dieting plates, and more particularly pertains to a new and improved dieting plate arrangement provided with compartments of predetermined and selective volumetric capacity.

2. Description of the Prior Art

The use of dieting plates and partition plates in the prior art is well known. The dieting plates of the prior art, however, have heretofore failed to provide a means of selectively and quantitatively determine compartments and their associate capacities, dependent upon individual needs in a dieting scenario. For example, U.S. Pat. No. 3,107,127 to Hong provides a conventional compartmentalized plate formed with a fixed divider dividing the interior of the plate into predetermined portions.

U.S. Pat. No. 3,773,312 to Sekuler provides for a child's feeding dish utilizing arcuate sides about a planar bottom formed with compartments therewithin.

U.S. Design Pat. No. 281,849 to Cantor provides for a diet plate formed with arcuate divider walls forming a compartmentalized interior.

U.S. Pat. No. 1,440,070 to Fry provides for a plate formed with projections extending upwardly from the bottom surface of the plate to form compartments within the plate.

U.S. Pat. No. 2,700,284 to Lyon provides for a compartmentalized plate of conventional construction.

As such, it may be appreciated that there is a continuing need for a new and improved dieting plate arrangement wherein the same addresses both the problems of providing compartments of conventional fluidic measurements for use by individuals on a predetermined diet, as well as addressing the problem of enabling arrangement of the compartments as desired.

SUMMARY OF THE INVENTION

In view of the foregoing disadvantages inherent in the known types of compartmentalized plates now present in the prior art, the present invention provides a dieting plate arrangement wherein the same provides for compartmentalized portions of predetermined volumetric capacity, as well as providing for improved divider walls to accommodate various foods of various temperature gradients. As such, the general purpose of the present invention, which will be described subsequently in greater detail, is to provide a new and improved dieting plate arrangement which has all the advantages of the prior art compartmentalized plates and none of the disadvantages.

To attain this, the present invention includes a compartmentalized plate formed with an annular side wall and a planar floor with the side wall terminating at its upper end in an annular planar rim. The interior of plate is formed with a divider to compartmentalize the interior plate into volumetric compartments of predetermined capacity relating to volumetric capacity in terms of one cup, one-half cup, one-fourth cup, and one-eighth cup. Further embodiments of the invention include each compartment provided with a gradation scale to indicate capacities based on relative density of fluids positioned therewithin. A further modification includes a removable divider wall malleable to modify capacities of various compartments within the plate. Modifications of the divider wall include a hollow divider wall formed with a dead air space, a divider wall formed with a fluid sealed compartment in each divider wall, and a divider wall utilizing both a sealed air and fluid chamber within each wall to accommodate fluids of various temperature gradients. The divider wall is positionable within predetermined grooves formed within the floor surface of the plate. A further modification utilizes a central hub formed with tubular recesses positioned within the outer surface of the hub coaxially of the hub to receive cylindrical terminal ends of partition walls utilized to form a divider within the plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dieting plate arrangement which has all the advantages of the prior art compartmentalized plates and none of the disadvantages.

It is another object of the present invention to provide a new and improved dieting plate arrangement which may be easily and efficiently manufactured and marketed.

It is a further object of the present invention to provide a new and improved dieting plate arrangement which is of a durable and reliable construction.

An even further object of the present invention is to provide a new and improved dieting plate arrangement which is susceptible of a low cost of manufacture with regard to both materials and labor, and which accordingly is then susceptible of low prices of sale to the consuming public, thereby making such dieting plate arrangements economically available to the buying public.

Still yet another object of the present invention is to provide a new and improved dieting plate arrangement which provides in the apparatuses and methods of the prior art some of the advantages thereof, while simultaneously overcoming some of the disadvantages normally associated therewith.

Still another object of the present invention is to provide a new and improved dieting plate arrangement to form compartments of predetermined volumetric capacities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross-sectional orthographic view of a yet further modified divider wall utilized by the instant invention.

FIG. 8 is an isometric segmented view of the divider wall and its association with the floor of the plate.

FIG. 9 is an isometric illustration of a further partition assembly utilized by the instant invention.

DESCRIPTION OF THE PREFERRED EMBODIMENT

Figure 1:
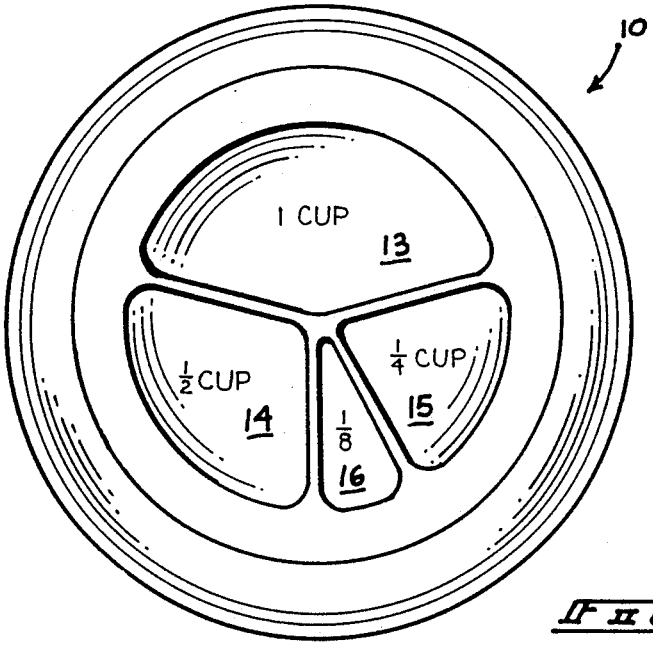
FIG. 1 is a top plan view of the instant invention.
Figure 2:
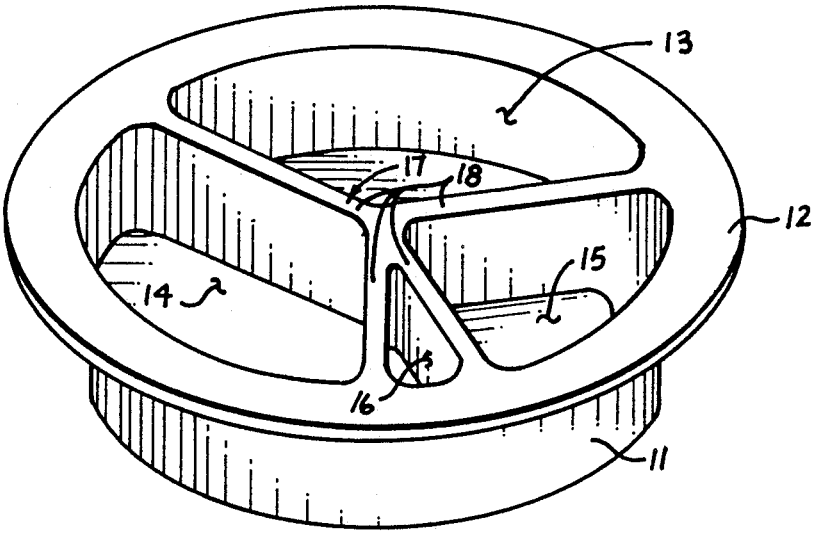
FIG. 2 is an isometric illustration of the instant invention.

With reference now to the drawings, and in particular to FIGS. 1 to 9 thereof, a new and improved dieting plate arrangement embodying the principles and concepts of the present invention and generally designated by the reference numeral 10 will be described.

More specifically, the dieting plate arrangement 10 of the instant invention essentially comprises a plate utilizing a planar bottom with an arcuate cylindrical side wall 11 extending orthogonally upwardly from the planar bottom and terminating at its upper end in a planar rim 12 oriented generally orthogonally relative to the side wall 11. The interior of the plate is compartmentalized into a respective first, second, third, and fourth compartment 13, 14, 15, and 16. A divider 17 formed with four partition walls 18 divides the plate into four compartments, wherein the four compartments 13 through 16 are divided into a one-cup, one-half cup, one-fourth, and one-eighth cup compartment respectively. The cup designation within the compartments is consistent with dieting portions allocated individuals in a dieting situation and enables an individual so dieting to more readily and easily plan meals.

Figure 3:
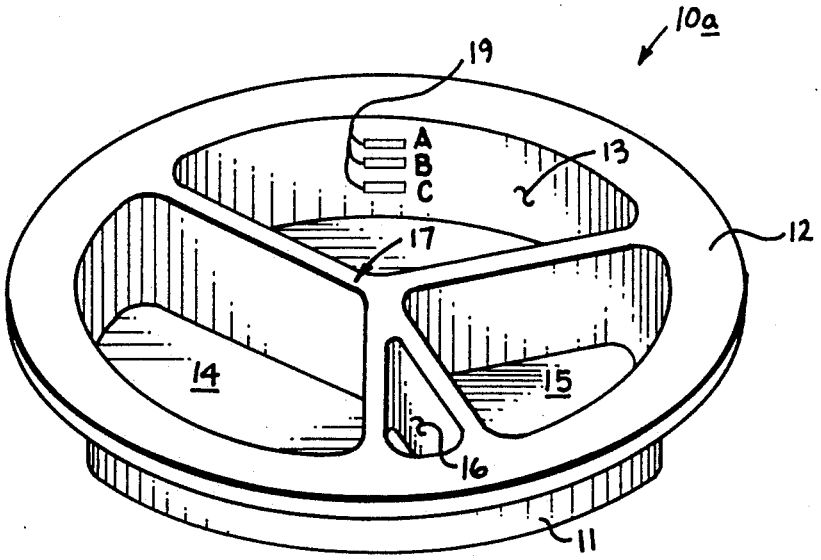
FIG. 3 is an isometric illustration of a first embodiment of the instant invention.

FIG. 3 is illustrative of a modified dieting plate arrangement **10*a* utilizing a volumetric gradation 19 divided into a series of indicators to accommodate various foods of varying food densities within the compartments formed by the divider 17**. The fluid capacity in combination with the volumetric gradations enables a more effective appreciation of various foods to be consumed.

Figure 4:
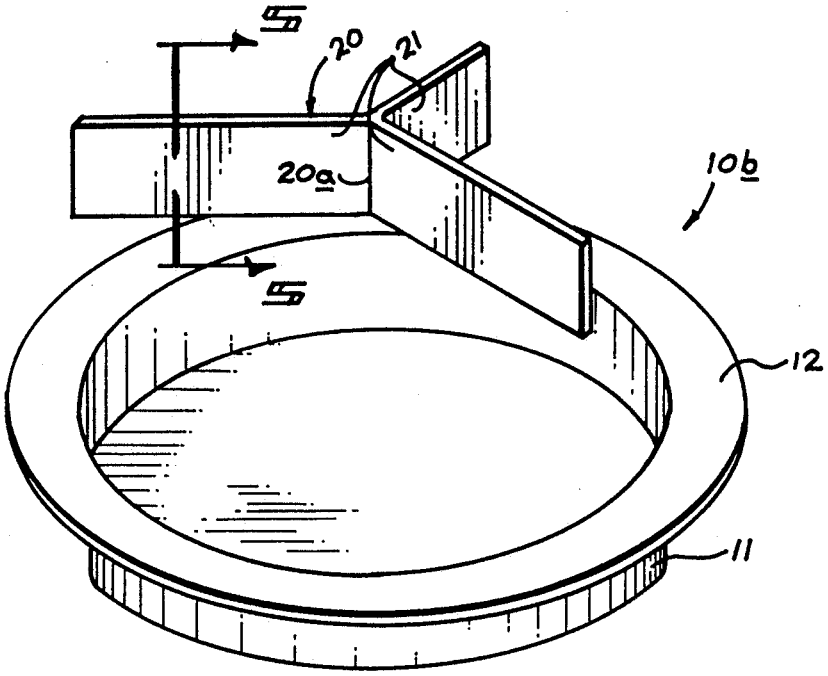
FIG. 4 is an isometric illustration of a second embodiment of the instant invention.

FIG. 4 is illustrative of a third embodiment dieting plate arrangement **10*b* utilizing a removable divider 20 formed with repositionable partition walls 21 pivotal about a pivot axis 20*a* formed at the intersection of the partition walls 21** to enable the partition walls to be repositioned and thereby form compartments within the plate of various capacities as a dieters requirements change.

Figure 5:
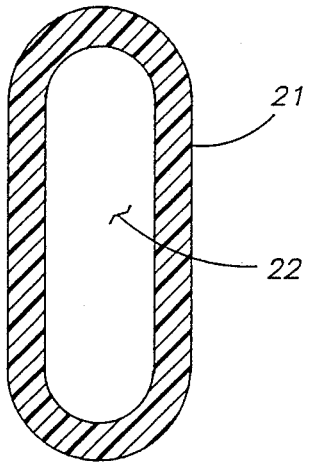
FIG. 5 is a cross-sectional view of the divider wall utilized by the instant invention.

FIG. 5 is illustrative of the partition walls 21 utilized with a hollow sealed chamber 22 formed within each wall in order that thermally warmer foods would not be adversely effected by colder foods positioned in adjacent compartments.

Figure 6:
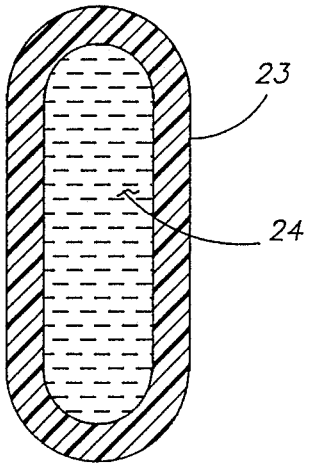
FIG. 6 is a cross-sectional orthographic view of a modified divider wall utilized by the instant invention.

FIG. 6 illustrates a modified partition wall 23 utilizing a fluid filled chamber 24 that may be preheated or chilled to assist in the control of food temperatures of foods positioned within the compartments formed by the divider.

FIG. 7 is illustrative of a second modified partition wall 25 utilizing a double-chambered wall formed with a first hollow sealed chamber 26 positioned parallel to and adjacent a second fluid filled chamber 27 to enable thermally heated foods to be positioned adjacent chilled foods without adversely enabling the adjacent foods to appreciably alter the temperature gradient of such foods.

FIG. 8 illustrates the divider 20 positionable within a positioning groove 29 of the floor 28 of the plate such that the removable divider may be returned to an initial position to provide chambers within the plate of a one-cup, one-half cup, and one-fourth compartment.

FIG. 9 illustrates an improved partition utilizing a central hub 33 of a predetermined height formed with cylindrical recesses 32 coaxially parallel to the axis of the hub 33 formed interiorly of the outer surface of the hub to accommodate the cylindrical terminal forward ends of modified partition walls 30, wherein the hub 33 and the associated walls may be positioned within the plate and provide predetermined compartments therewithin. It should be noted that the walls 30 may also be formed of hollow, fluid filled, or a combination of the fluid and hollow chambers, as illustrated in FIG. 3.

As to the manner of usage and operation of the instant invention, the same should be apparent from the above disclosure, and accordingly no further discussion relative to the manner of usage and operation shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dieting plate arrangement comprising, a receptacle including a planar floor, a continuous wall directed upwardly from said floor and integrally formed thereto terminating at its upper end and a planar rim extending outwardly of the wall, and a divider including a plurality of partition walls to define a plurality of compartments within the container wherein the compartments are of varying and predetermined volumetric capacities, and wherein at least one of the compartments is formed with a plurality of volumetric gradations formed upon an interior surface of the wall to provide further indication of varying volumes of foods within the at least one compartments, and wherein the divider is removably mounted within the receptacle, and wherein each partition wall of the divider is pivotally mounted at an intersection defined by a junction of the partition walls to enable repositioning of the partition walls relative to one another to form compartments of varying capacities, and wherein each partition wall is movably mounted relative to the divider, and wherein the divider includes a central cylindrical hub, the cylindrical hub includes a series of cylindrical recesses formed within an outer wall of the hub, each of the recesses axially aligned relative to an axis of the hub, and each cylindrical recess formed of a complementary configuration relative to a cylindrical terminal end formed at each forward terminal end of each partition wall to selectively accommodate the partition walls about the hub.

2. A dieting plate arrangement as set forth in claim 1 wherein each of the partition walls are formed with a sealed hollow chamber.

3. A dieting plate arrangement as set forth in claim 1 wherein each of the partition walls are formed with a fluid filled chamber.

4. A dieting plate arrangement as set forth in claim 1 wherein each of the partition walls are formed with parallel chambers, a first chamber formed as a hollow sealed chamber and a second chamber formed as a fluid filled chamber.

* * * * *